US005324942A

United States Patent [19]

Mishra et al.

[11] Patent Number: 5,324,942

[45] Date of Patent: Jun. 28, 1994

[54] TUNABLE SCOROTRON FOR DEPOSITING UNIFORM CHARGE POTENTIAL

[75] Inventors: Satchidanand Mishra, Webster; Edward A. Domm; Denis C. Thomas, both of Hilton, all of N.Y.

[73] Assignee: Xerox Corporation, Stamford, Conn.

[21] Appl. No.: 992,512

[22] Filed: Dec. 17, 1992

[51] Int. Cl.[5] ..... H01T 19/04

[52] U.S. Cl. ..... 250/326; 250/324

[58] Field of Search ..... 250/324, 325, 326; 355/225

[56] References Cited

U.S. PATENT DOCUMENTS

| | | | |
|---|---|---|---|
| 2,777,957 | 1/1957 | Walkup | 250/49.5 |
| 2,965,754 | 12/1960 | Bickmore et al. | 250/49.5 |
| 3,688,107 | 8/1972 | Schneider et al. | 250/324 |
| 3,934,141 | 1/1976 | Vargas | 250/325 |
| 3,937,960 | 2/1976 | Matsumoto et al. | 250/326 |
| 4,112,299 | 9/1978 | Davis | 250/326 |
| 4,318,610 | 3/1982 | Grace | 355/140 |
| 4,335,420 | 6/1982 | Mitsuo et al. | 355/225 |
| 4,408,865 | 10/1983 | Camis et al. | 250/324 |
| 4,456,365 | 7/1984 | Yuasa | 355/3 CH |
| 4,638,397 | 1/1987 | Foley | 361/212 |
| 4,652,754 | 3/1987 | Almeter et al. | 250/326 |
| 5,025,155 | 6/1991 | Hattori | 250/326 |
| 5,079,668 | 1/1992 | Maeshima | 355/225 |
| 5,206,784 | 4/1993 | Kimiwada et al. | 355/225 |

OTHER PUBLICATIONS

"Photoreceptor Charging Scorotron"; Swistak; Xerox Disclosure Journal; vol. 10, No. 3, May/Jun. 1985; pp. 139–141.

"Micrometer Adjustment for Inboard–Outboard Balancing of Scorotron Charge Devices"; Poskus et al.; Xerox Disclosure Journal, vol. 17, No. 3, May/Jun. 1992, pp. 139–140.

"Corrugated Scorotron Screens"; Bergen et al, Xerox Disclosure Journal, vol. 17, No. 4, Jul./Aug. 1992, pp. 239–240.

"Charge Scorotron"; Cozad; IBM Technical Disclosure Journal; vol. 19, No. 8, Jan. 1977, pp. 2907–2908.

"*Electrophotography*"; Schaffert, Focal Press, London (1971).

*Primary Examiner*—Bruce C. Anderson

*Attorney, Agent, or Firm*—Duane C. Basch

[57] ABSTRACT

The present invention is an apparatus for tuning or altering the charge potential limiting effect that a scorotron grid has upon an adjacent charge receiving surface. The scorotron charging apparatus utilizes corona producing means, spaced above the charge retentive surface, for emitting corona ions in response to a high voltage potential applied thereto, and a flexible grid, suspended between said corona producing means and the charge retentive surface in a nonplanar fashion, such that the spacing between said grid and the charge retentive surface is variable along at least one region of said grid.

18 Claims, 8 Drawing Sheets

TUNABLE SCOROTRON FOR DEPOSITING UNIFORM CHARGE POTENTIAL

This invention relates generally to a scorotron charging device, and more particularly to an adjustable grid scorotron that applies a uniform charge to a charge retentive surface.

CROSS REFERENCE

The following related application is hereby incorporated by reference for its teachings:

U.S. patent application Ser. No. 07/991,910 to Mishra et al., entitled "Electrically Tunable Charging Device for Depositing Uniform Charge Potential," filed concurrently herewith now U.S. Pat. No. 5,300,986.

BACKGROUND AND SUMMARY OF THE INVENTION

The present invention controls the uniformity and magnitude of corona charging of a charge retentive, photoresponsive surface. The tunable scorotron makes use of an open screen grid as a control electrode, to establish a reference potential, so that when the receiver surface reaches the grid's reference potential, the corona generated electric fields no longer drive ions to the receiver, but rather to the grid. Many factors can contribute to charge nonuniformity across the surface of a photoresponsive member. For example, nonuniformity in the thickness of the photoresponsive layers and edge effects both impact the charging characteristics of a photoresponsive member. Furthermore, the nonuniformity can be exacerbated upon aging of the photoresponsive member due to the higher charge levels needed to produce a desired potential on the photoresponsive surface.

Heretofore, numerous variations of scorotron charging systems have been developed, of which the following disclosures may be relevant:

U.S. Pat. No. 2,777,957; Patentee: Walkup; Issued: Jan. 15, 1957.

U.S. Pat. No. 2,965,754; Patentee: Bickmore et al.; Issued: Dec. 20, 1960.

U.S. Pat. No. 3,937,960; Patentee: Matsumoto et al.; Issued: Feb. 10, 1976.

U.S. Pat. No. 4,112,299; Patentee: Davis; Issued: Sep. 5, 1978.

U.S. Pat. No. 4,456,365; Patentee: Yuasa; Issued: Jun. 26, 1984.

U.S. Pat. No. 4,638,397; Patentee: Foley; Issued: Jan. 20, 1987.

U.S. Pat. No. 5,025,155; Patentee: Hattori; Issued: Jun. 18, 1991.

Xerox Disclosure Journal; Vol. 10, No. 3; May/June 1985.

Xerox Disclosure Journal; Vol. 17, No. 3; May/June 1992.

Xerox Disclosure Journal; Vol. 17, No. 4; July/August 1992.

IBM Technical Disclosure Bulletin; Vol. 19, No. 8; January 1977.

The relevant portions of the foregoing patents may be briefly summarized as follows:

U.S. Pat. No. 2,777,957 discloses a corona discharge device for electrically charging an insulating layer. A conductive grille is interposed between the ion source, for example, the corona discharge electrode, and the insulating layer, preferably a photoconductive insulating layer. The grille is maintained at a potential below the voltage of the corona discharge electrode and produces a uniform charge potential across the insulating layer.

U.S. Pat. No. 2,965,754 describes a double screen corona device having a pair of corona screens to substantially eliminate charge nonuniformity, referred to as charge streaking. The screens, inserted between the corona element and an insulating layer, are arranged in a parallel fashion overlapping one another so as to diffuse the ions emitted by the corona element before they are deposited on an insulating layer. Both screens may be maintained at slightly different potentials, however, the screen closest to the insulating layer is maintained at a potential between four and ten times the maximum potential to which the insulating layer is to be raised.

U.S. Pat. No. 3,937,960 discloses a charging device for an electrophotographic apparatus having a movable control plate. The control plate, commonly referred to as a shield, is formed of a flexible conductive material. The control plate may be moved relative to a corona producing wire, such that the movement of the plate produces a corresponding variation in the ion flow from the wire.

U.S. Pat. No. 4,112,299 teaches a corona charging device having an elongated wire and a surrounding conductive shield which is segmented in a direction parallel to the wire. Each of the conductive shield segments may be biased at different potentials in order to produce a universal corona generating device which is adaptable to a variety of situations.

U.S. Pat. No. 4,456,365 discloses a corona charging device for uniformly charging an image forming member which includes a corona wire and a conductive shield which partially surrounds the wire. The Image forming member is uniformly charged by applying an AC voltage to the corona wire, along with an additional DC bias voltage.

U.S. Pat. No. 4,638,397 describes a scorotron where the wire grid is connected to ground via a plurality of Zener diodes and a variable resistor. The control circuit employed effectively limits the charge potential which is deposited on a photoconductive layer by varying the voltage applied to a control grid as a fraction of the nominal voltage applied to the grid.

U.S. Pat. No. 5,025,155 teaches a corona charging device for charging the surface of a moving member which includes a plurality of corona generating electrodes and a grid electrode located between the moving member and the wire electrodes. Increased surface potential is achieved on the moving member utilizing a plurality of wire electrodes, where the distance between the grid electrode and the moving member is shortest beneath the downstream electrode.

Xerox Disclosure Journal (Vol. 10, No. 3; May/June 1985) teaches, at pp. 139–140, a charging scorotron employing a scorotron grid which is segmented on one end thereof in order to selectively avoid the creation of unused charged areas on an adjacent photoreceptor. The two disclosed segments at the end of the scorotron are switchably connected to a potential source so that in all cases the photoreceptor width corresponding to the image size of the smallest copy sheet is always charged.

Xerox Disclosure Journal (Vol. 17, No. 3; May/June 1992) it illustrates, at pp. 139–140, a micrometer adjustment suitable for leveling the scorotron in an imaging device. The micrometer head may be used to accurately adjust the scorotron wire with respect to the surface of a reprographic element.

Xerox Disclosure Journal (Vol. 17, No. 4; July/August 1992) describes, at pp. 239-240 a corrugated scorotron screen having corrugations which run orthogonal to the process direction of a charge receptor. As noted, the added strength and rigidity provided by the corrugations within the screen help to maintain flatness and rigidity of the screen.

IBM Technical Disclosure Bulletin (Vol. 19, No. 8; January 1977) discloses, at pp. 2907-2908, a scorotron used in a xerographic process to charge a photoconductor. Accurate positioning of the scorotron grid wires is achieved by using a plastic block along with separate mechanical locating means to position the wires.

In accordance with the present invention, there is provided a scorotron charging apparatus adapted to apply a uniform charge to a charge retentive surface. The apparatus comprises corona producing means, spaced from the charge retentive surface, for emitting corona ions, and a flexible grid, interposed between said corona producing means and the charge retentive surface in a nonplanar fashion, with the spacing between said grid and the charge retentive surface being variable along a region of said grid.

In accordance with another aspect of the present invention, there is provided an electrophotographic imaging apparatus for producing a toned image, including a photoconductive member, means for charging a surface of said photoconductive member, means for exposing the charged surface of said photoconductive member to record an electrostatic latent image thereon, and means for developing the electrostatic latent image recorded on said photoconductive member with toner to form a toned image thereon. The charging means includes corona producing means, spaced from the surface of said photoconductive member, for emitting corona ions, and a flexible grid, interposed between said corona producing means and the surface of said photoconductive member in a nonplanar fashion, with the spacing between said grid and the surface of said photoconductive member being variable along at least a region of said grid.

BRIEF DESCRIPTION OF THE DRAWINGS

FIG. 7 is a graph illustrating expected voltage and charge profiles across the surface of the photoreceptor depicted in FIG. 5 using an ideal scorotron device, while

The present invention will be described in connection with a preferred embodiment, however, it will be understood that there is no intent to limit the invention to the embodiment described. On the contrary, the intent Is to cover all alternatives, modifications, and equivalents as may be included within the spirit and scope of the invention as defined by the appended claims.

DESCRIPTION OF THE PREFERRED EMBODIMENT

Figure 9:
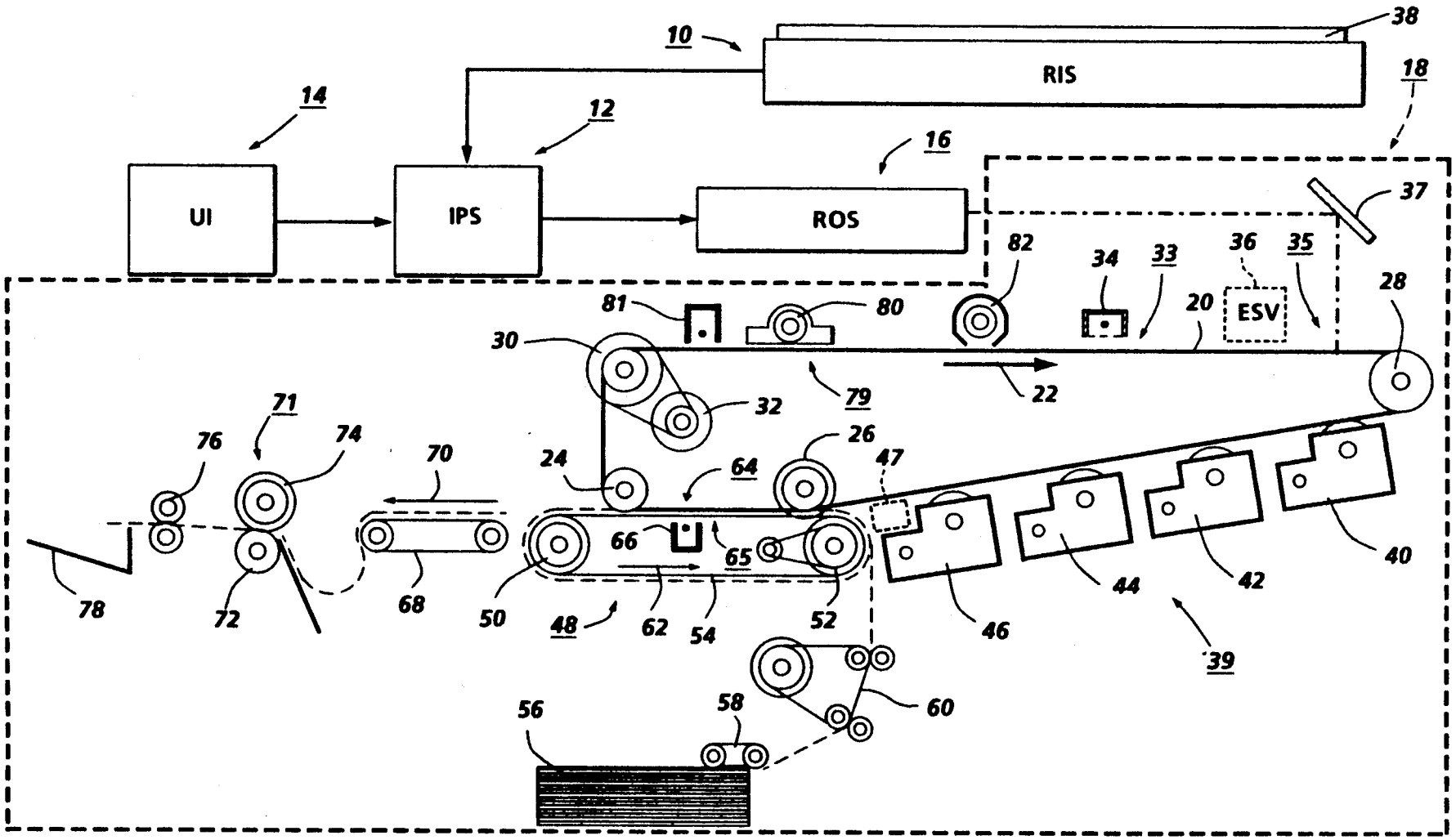
FIG. 9 is a schematic elevational view showing an electrophotographic printing machine incorporating the features of the present invention therein.

For a general understanding of the present invention, reference Is made to the drawings. In the drawings, like reference numerals have been used throughout to designate identical elements. FIG. 9 shows a schematic elevational view of an electrophotographic printing machine incorporating the features of the present invention therein. It will become evident from the following discussion that the present invention is equally well suited for use in a wide variety of printing systems, and is not necessarily limited in its application to the particular system shown herein.

Turning first to FIG. 9, during operation of the printing system, a multicolor original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it Into a series of raster scan lines and, moreover, measures a set of primary color densities (i.e. red, green and blue densities) at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (U1), indicated generally by the reference numeral 14, is in communication with IPS 12. U1 14 enables an operator to control the various operator adjustable functions. The operator actuates the appropriate keys of U1 14 to adjust the parameters of the copy. U1 14 may be a touch screen, or any other suitable control panel, providing an operator interface with the system. The output signal from U1 14 is transmitted to IPS 12. The IPS then transmits signals corresponding to the desired image to ROS 16, which creates the output copy image.

ROS 16 includes a laser with rotating polygon mirror blocks. The ROS illuminates, via mirror 37, the charged portion of a photoresponsive belt 20 of a printer or marking engine, indicated generally by the reference numeral 18, at a resolution of about 400 pixels per inch, to achieve a set of subtractive primary latent images. The ROS will expose the photoconductive belt to record three latent images which correspond to the signals transmitted from IPS 12. One latent image is developed with cyan developer material. Another latent Image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 9, printer or marking engine 18 is an electrophotographic printing machine. Photoresponsive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22. The speed of the belt is monitored in conventional fashion, and directly controlled by motor 32.

Describing now the operation of the printing engine, initially, a portion of photoconductive belt 20 passes through a charging station, indicated generally by reference numeral 33. At charging station 33, a scorotron 34 charges photoconductive belt 20 to a relatively high, substantially uniform potential. Specific details of scorotron 34 will be further described with respect to the remaining drawing figures.

Next, the charged photoconductive surface is rotated to an exposure station, indicated generally by the reference numeral 35. Exposure station 35 receives a modulated light beam corresponding to information derived by RIS 10 having a multicolored original document 38 positioned thereat. The modulated light beam impinges on the surface of photoconductive belt 20. The beam illuminates the charged portion of photoconductive belt to form an electrostatic latent image. The photoconductive belt is exposed at least three times to record latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type commonly known as "magnetic brush development units." Typically, a magnetic brush development system employs a magnetizable developer material including magnetic carrier granules having toner particles adhering triboelectrically thereto. The developer material is continually advanced through a directional flux field to form a brush of developer material. The developer material Is constantly moving so as to continually provide the brush with fresh developer material.

Development is achieved by bringing the brush of developer material into contact with the photoconductive surface. Developer units 40, 42, and 44, respectively, apply toner particles of a specific color which correspond to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced, or discharged, to a voltage level ineffective for development. The remaining charged areas are then made visible by having developer unit 40 apply green absorbing (magenta) toner particles onto the electrostatic latent image recorded on photoconductive belt 20, as is commonly referred to as charged area development. Similarly, during a subsequent development cycle, a blue separation is developed by developer unit 42 with blue absorbing (yellow) toner particles, while during yet another development cycle the red separation is developed by developer unit 44 with red absorbing (cyan) toner particles. Developer unit 46 contains black toner particles and may be used to develop the electrostatic latent image formed from a black and white original document, or that portion of the color image determined to be representative of black regions. Each of the developer units is moved into and out of an operative position. In the operative position, the magnetic brush is positioned substantially adjacent the photoconductive belt, while in the nonoperative position, the magnetic brush is spaced apart therefrom. More specifically, in FIG. 9, developer unit 40 is shown in the operative position with developer units 42, 44 and 46 being in nonoperative positions. During development of the color separations associated with each of the electrostatic latent images, only one developer unit is in the operative position, the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone 64, where the toner image is transferred to a sheet of support material, such as plain paper. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet is advanced from a stack of sheets 56 disposed on a tray. A friction retard feeder 58 advances the uppermost sheet from stack 56 onto a pretransfer transport 60. Transport 60 advances the sheet to sheet transport 48 in synchronism with the movement of the sheet gripper. In this way, the leading edge of a sheet arrives at a preselected position, i.e. a loading zone, to be received by the open sheet gripper. The leading edge of the sheet is secured releasably by the sheet gripper. As belts 54 move in the direction of arrow 62, the sheet moves into contact with the photoconductive belt, in synchronism with the toner image developed thereon. In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under-color or black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to vacuum conveyor 68 which transports the sheet, in the direction of arrow 70, to fusing station 71, where the transferred toner Image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, Is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Cleaning station 79 may also employ preclean corotron 81, in association with brush 80, to further neutralize the electrostatic forces which attract the residual toner particles to belt 20, thereby improving the efficiency of the fibrous brush. Thereafter, lamp 82 illuminates photoconductive belt 20 to remove any residual charge remaining thereon prior to the start of the next successive cycle.

Figure 1:
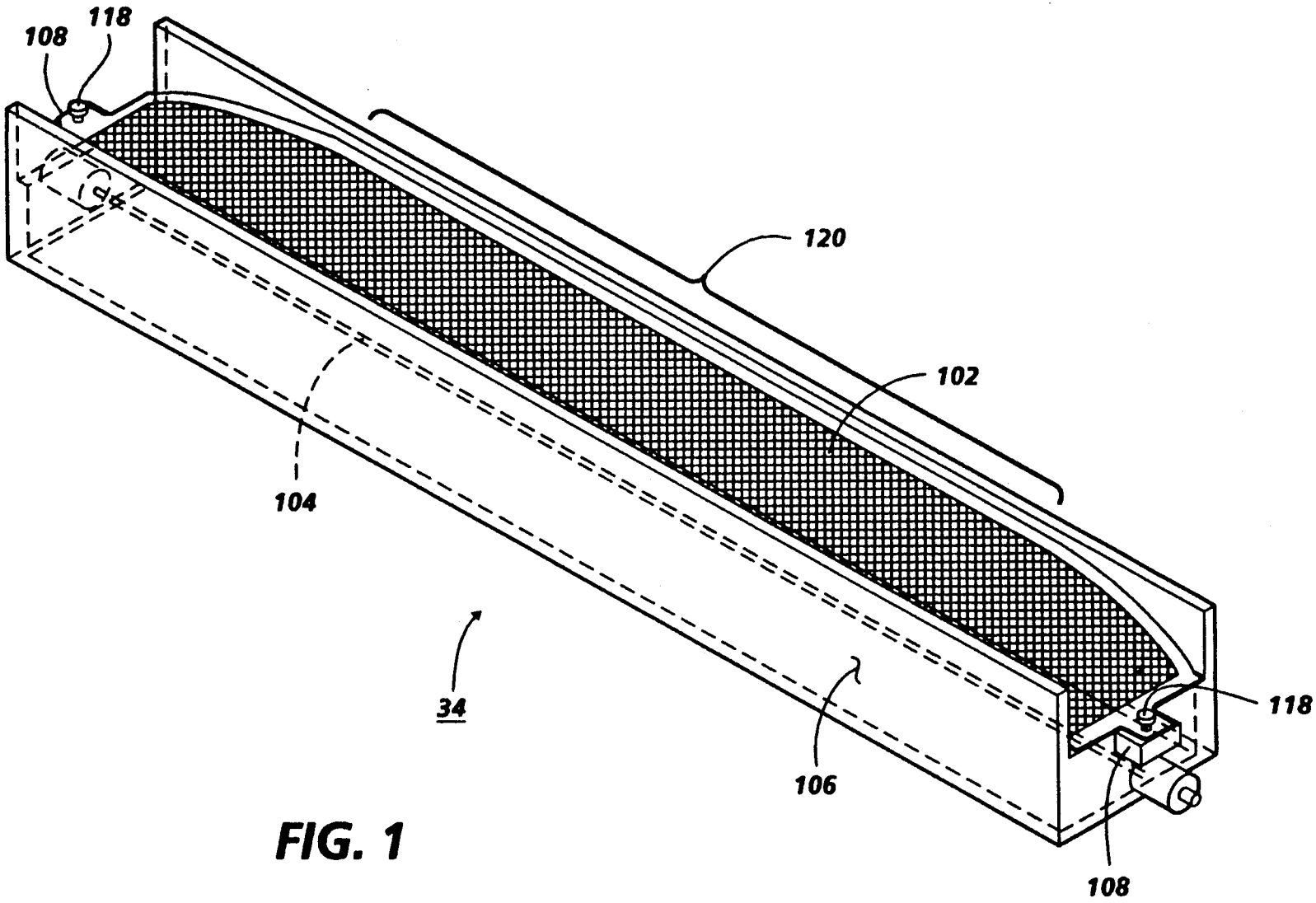
FIGS. 1, 2, 3, and 4 illustrate various perspective and orthographic views of an illustrative embodiment of the present invention.
Figure 2:
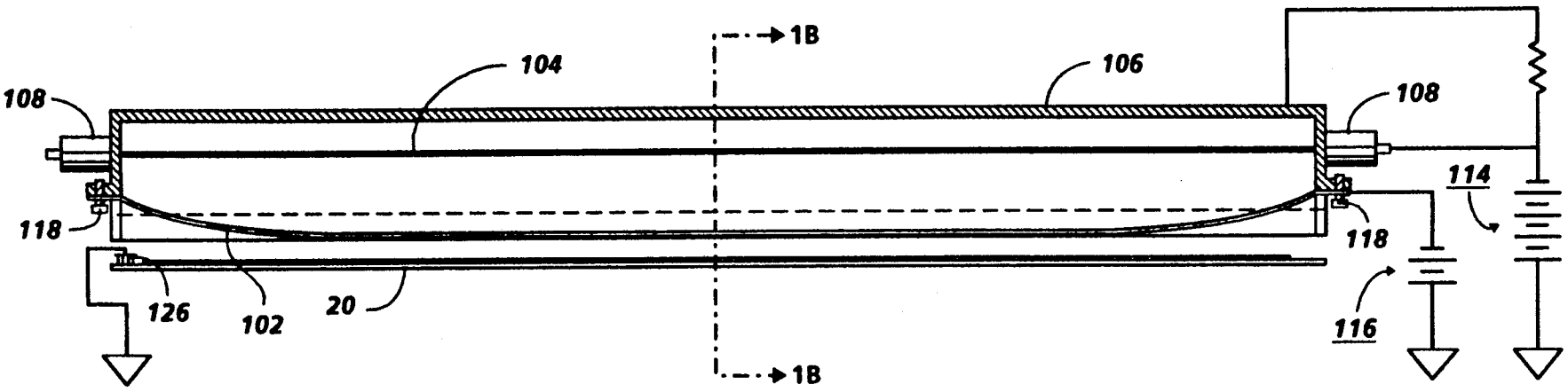
Figure 3:
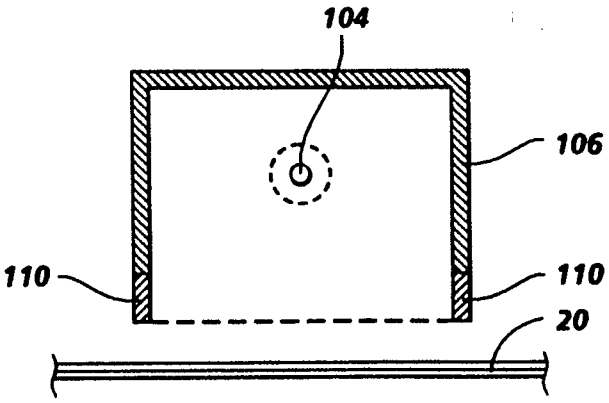
Figure 4:
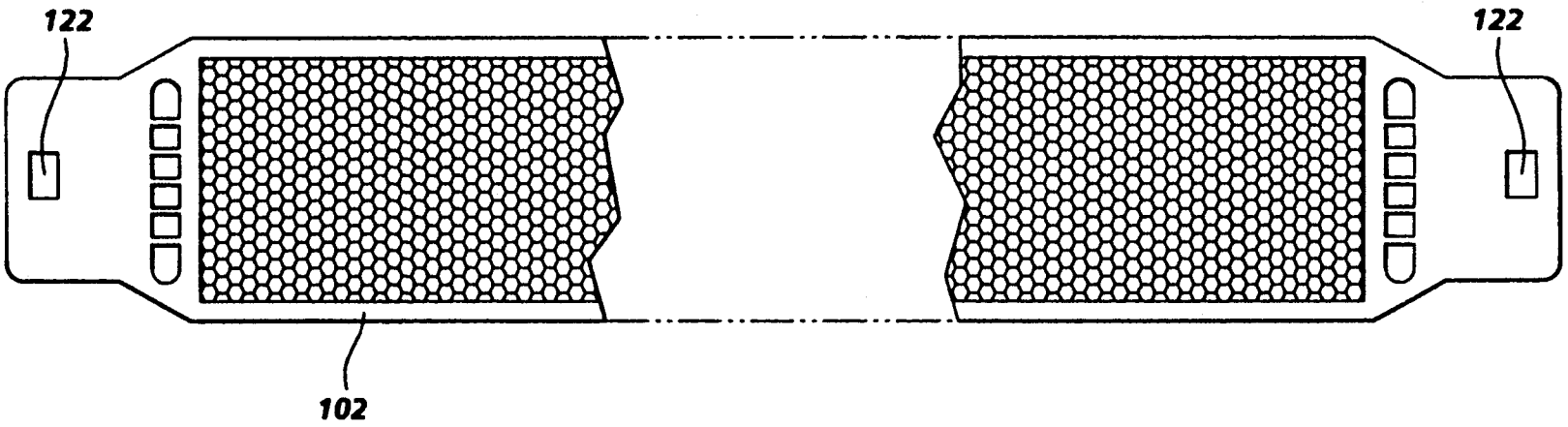
Figure 5:
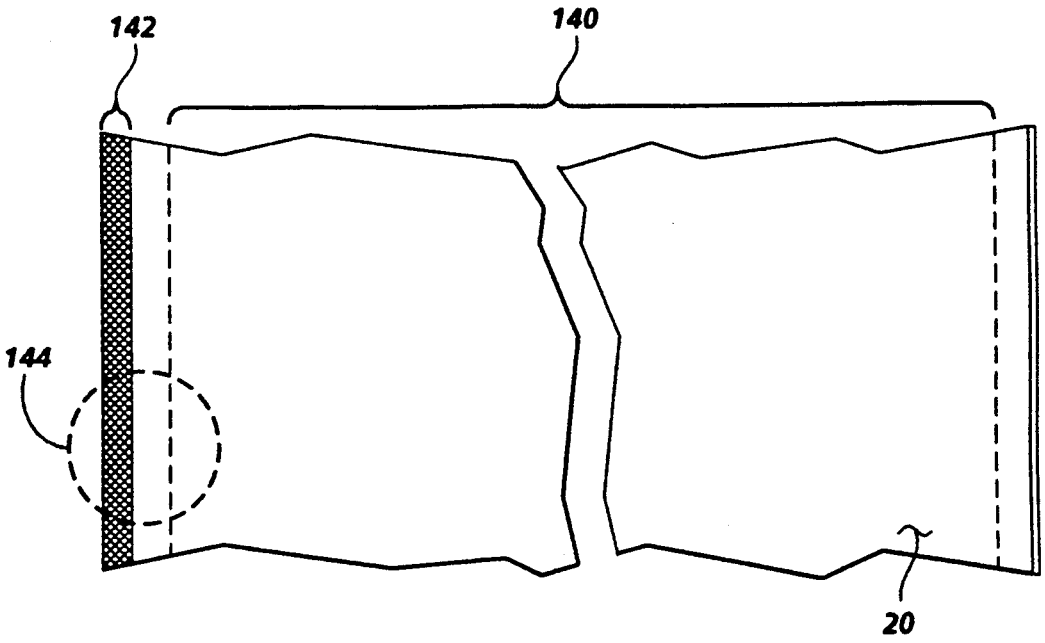
FIG. 5 is an illustration of a portion of a photoreceptor illustrating various regions on the surface thereof.

Referring now to FIG. 1, in conjunction with FIGS. 2 through 4, which depict various portions of the tunable scorotron of FIG. 1, scorotron 34 is comprised of a flexible grid 102, and a corona generating element 104 enclosed within a U-shaped shield 106. Flexible grid 102 may be made from any flexible, conductive, perforated material, and is preferably formed from a thin metal film having a pattern of regularly spaced perforations opened therein, as illustrated in FIG. 4. As illustrated, corona generating element 104 is a commonly known wire or thin rod-like member, however, a variety of comb-shaped pin arrangements may also be employed as the corona generating element. The three primary elements of the tunable scorotron, 34; the flexible grid, the shield, and the corona generating element, are maintained in electrical isolation from one another so as to prevent electrical current from flowing directly from one to another. More specifically, corona element mounts 108 are used to electrically insulate the corona generating element from shield 106, as well as, to rigidly position corona element 104 with respect to the shield. Similarly, the flexible grid, while being generally supported by or suspended from shield 106, is insulated therefrom by insulators 110 which form natural extensions of the legs of shield 106. Furthermore, the entire scorotron assembly, 34, is positioned in a direction parallel to the surface of photoreceptor belt 20, yet perpendicular to the direction of travel of the belt.

As indicated by the simplified electrical schematic depicted in FIG. 2, both the shield 106 and the corona element 104 are maintained at a high voltage potential by power supply 114, the difference in potential between the two is controlled by resistor R, which may be any fixed or variable resistor suitable for use in the high voltage circuit. Typically, the potential of high voltage power supply 114 Is in the range of 1 to 10 kilovolts (kV), preferably at about 6 kV, thereby maintaining the corona element at a potential of about 6 kV and the shield in the range of about 0 to 1 kV. Likewise, grid 102 Is also maintained at a predetermined voltage potential by high voltage supply 116, typically in the range of 0.5 kV to 1.5 kV, and preferably at about 1.0 kV. More importantly, as described by R. M. Schaffert in *Electrophotography*, Focal Press, London (1971), the relevant portions therein being hereby incorporated by reference, the ion current ($I_p$) passing from the corona element to the surface of photoconductive belt 20 is represented as follows:

$$I_p = I_s - I_g, \qquad \text{Eq. 1}$$

where $I_s$ is the corona current generated by the corona effusing element 104, and $I_g$ is the ion current flowing to the grid. More specifically, $$I_s = A_s(V - V_s)(V - V_s - V_0), \text{ and} \qquad \text{Eq. 2}$$

$$I_g = A_g(V - V_g)(V - V_g - V_0), \qquad \text{Eq. 3}$$

where $V_0$ is the critical corona onset voltage, V is the voltage potential on corona element 104, $V_s$ the potential of the photoreceptor surface, and $V_g$ the grid potential. Furthermore, constants $A_s$ and $A_g$ are dependent upon the geometry and spacing of the wire and grid, respectively, and their relationship with other elements In close proximity. Specifically, $A_g$ pertains to the grid geometry, for example, the pattern of the grid (FIG. 4), the area of the open space in the grid, as well as the spatial relationships between the grid and the corona element and the grid and the photoreceptor surface.

As further illustrated in FIGS. 1 and 2, for example, thumb screws 118, positioned on each end of scorotron 34, may be used to adjust the position of the end sections of the grid. Effectively, this allows the central region of grid 104, as indicated by reference numeral 120 in FIG. 1, to be held in a generally planar position, while the opposite ends of the grid may be independently adjusted up or down in order to vary the spatial relationship between the grid and the photoreceptor belt surface. In addition, alternative methods of adjusting the location of the unconstrained grid ends are understood to exist, and would include a plurality of spaced-apart ratcheting teeth (not shown) disposed in a linear direction for releasably constraining an interior portion of aperture 122 through which they would extend.

Figure 6:
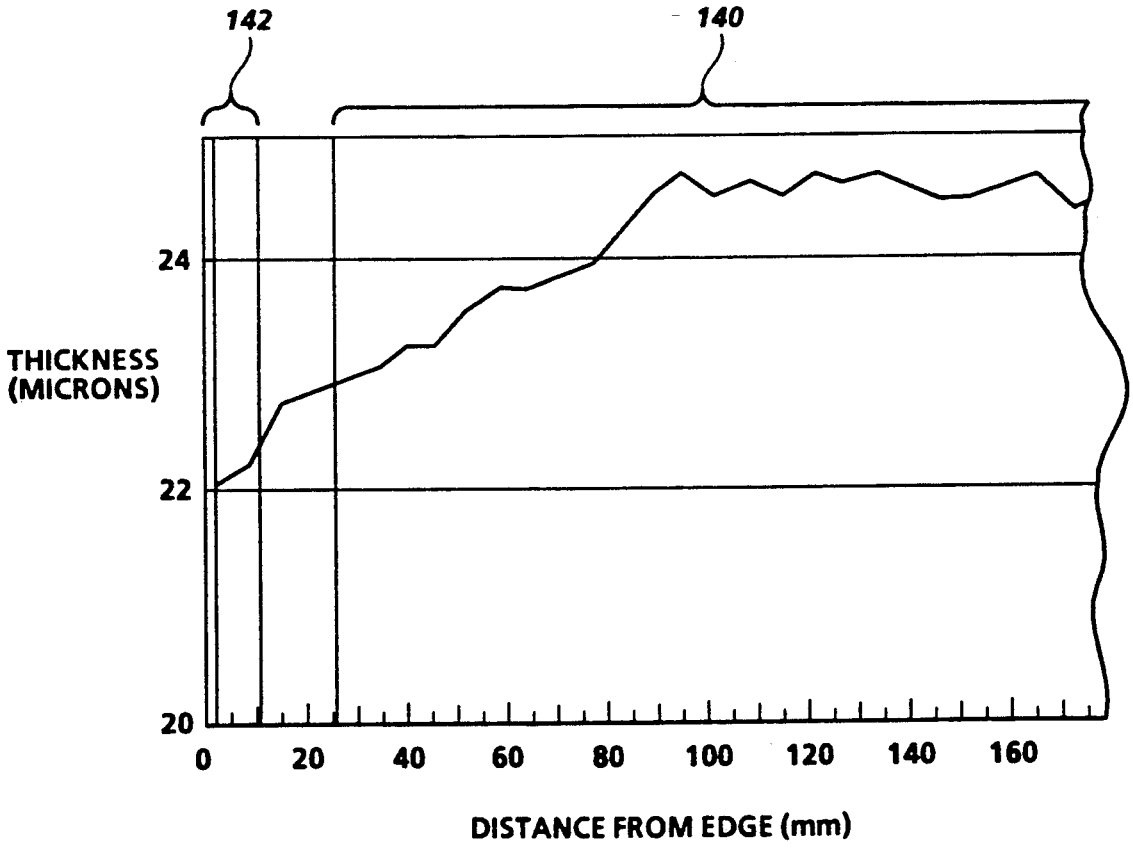
FIG. 6 is a graph illustrating the thickness profile of the photoreceptor depicted in FIG. 5.
Figure 7:
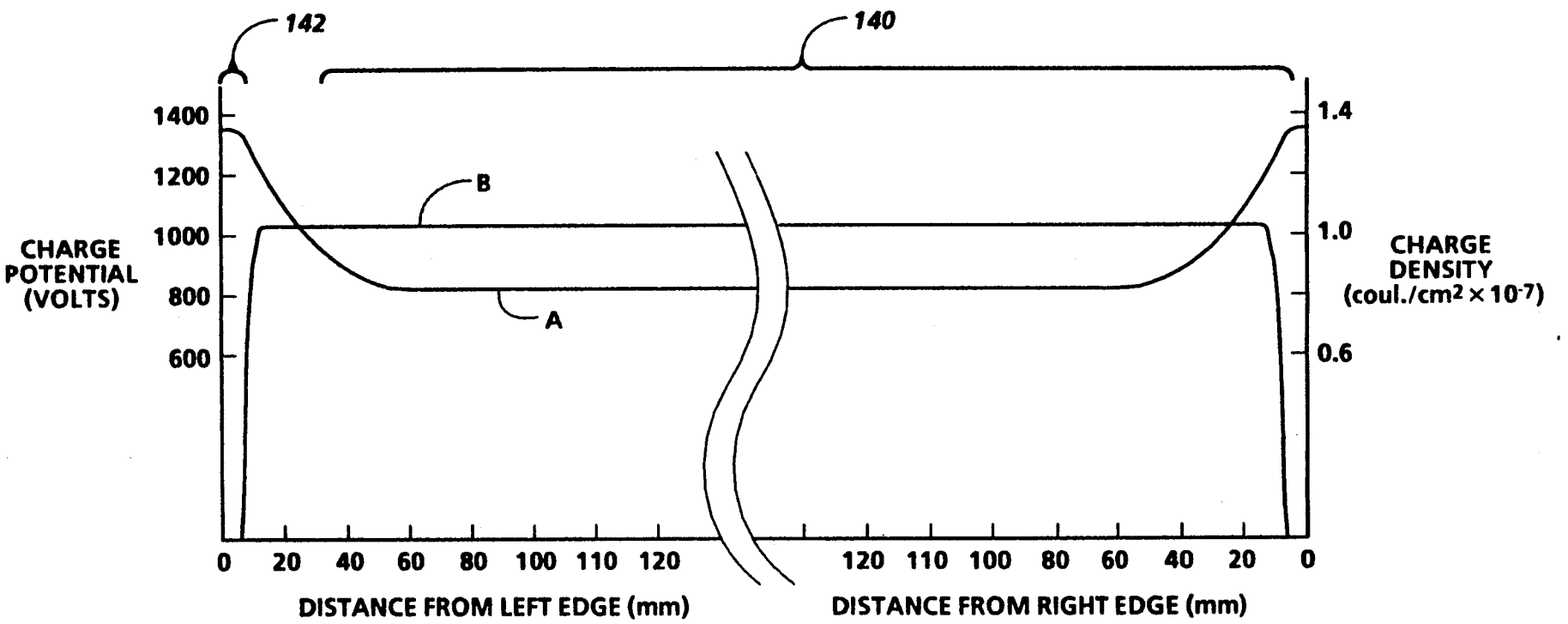
Figure 8:
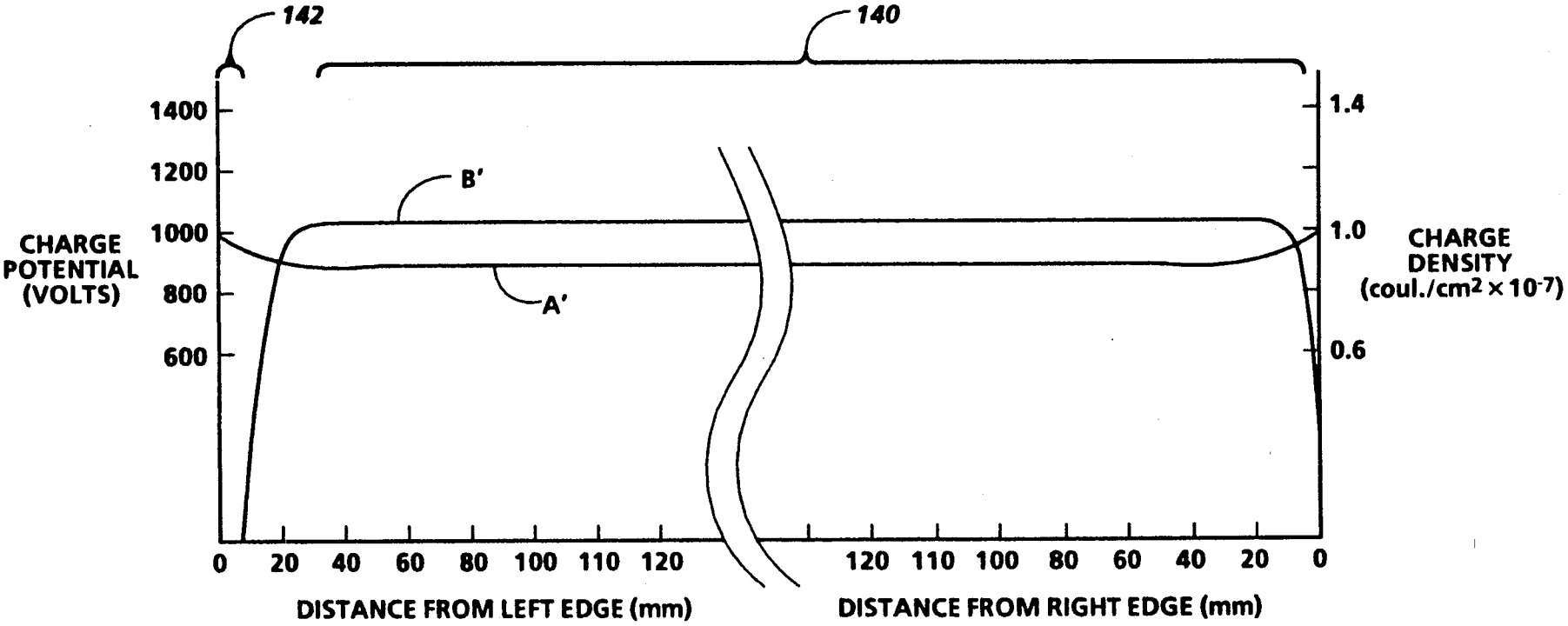
FIG. 8 is a graph illustrating similar voltage and charge profiles for a scorotron device employing the present invention.

Referring now to FIGS. 5, 6, 7, and 8, photoreceptor belt 20 is generally coated within and extending slightly beyond a center Imaging region 140, which forms the usable imaging area thereon. Along one side, belt 20 further includes a ground strip region 142 which is uncoated by the photoresponsive layers present in the imaging region, in order to allow the belt to be grounded by contacting brush 126, or a similar grounding device, as illustrated in FIG. 2. Along both edges of imaging region 140, for example the region identified by reference numeral 144, there may be a characteristic "fall-off" in the thickness profile of the photoconductive layer present on the surface of the belt, as illustrated in FIG. 6. Coupled with the proximity of the ground strip, the thickness profile nonuniformity would result in the charge density and voltage profiles represented in FIG. 7 as curves A and B, respectively, when subjected to an "ideal" scorotron charging device. Such a device would be capable of supplying copious amounts of charged ions to bring the voltage potential to a uniform level across the coated surface of photoresponsive belt 20. For example, at a point where the thickness of the photoconductive coating is thinner than a nominal thickness of about 24 microns, portions of region 144, a higher charge density will be deposited, whereas the opposite will be true for thicker photoconductive regions. Thus, for an "ideal" scorotron charging system, the charge density profile will be inversely proportional to the thickness of the photoconductive layer being charged.

However, for typical scorotron charging devices, there is a practical limit to the ion current which can be generated. Hence, the charge density nonuniformity during a charging operation with a common planar scorotron device would be less pronounced than the edge nonuniformity illustrated in curve A of FIG. 7. Similarly, there would be an impact to the charge potential distribution, resulting in a characteristic decrease in the potential near the edges of the photoconductive coating, generally proportional to the change in thickness of the photoconductive coating.

On the other hand, it is possible, using the tunable features of the present invention, to adjust the grid-to-photoreceptor spacing to achieve a more uniform charge density or voltage profile across the entire width of imaging region 140, as needed for the particular development system used. As an example, with the fall-off in charge density exhibited in curve A of FIG. 7, the left end of flexible grid 102 would be adjusted so as to allow more space between the grid and the surface of photoreceptor belt 20. The voltage deposited by a scorotron at a point on the surface of the photoreceptor depends upon the separation of grid and the photoreceptor surface, following the general rule that the greater the distance between the two, the lower the voltage potential that will be reached on the surface. Therefore by locally increasing the distance between the grid and the photoreceptor the charge will also be reduced locally. If it is desirable to reduce the charge density peaks near the edges of the photoreceptor, as shown in curve A of FIG. 7, the separation distance is increased resulting in a slight depression of the voltage near the edges and lowering the charge density. In other case, where it is desired to have a uniform voltage profile, which is not obtainable by a less than "ideal" scorotron, it is possible to adjust the distance suitably to give a more uniform profile of voltage. Similarly, the grid spacing may be slightly increased or decreased on the right side of the scorotron as well, to compensate for any charge density nonuniformity occurring within the right side of imaging area 140. The resulting charge density and charge potential profiles are represented by curves A' and B', respectively, in FIG. 8. There, the impact of the thickness variation in the photoconductive coating is controlled at least within the imaging region so as to significantly reduce or eliminate the deleterious effects on copy quality caused by the nonuniformity.

Figure 10:
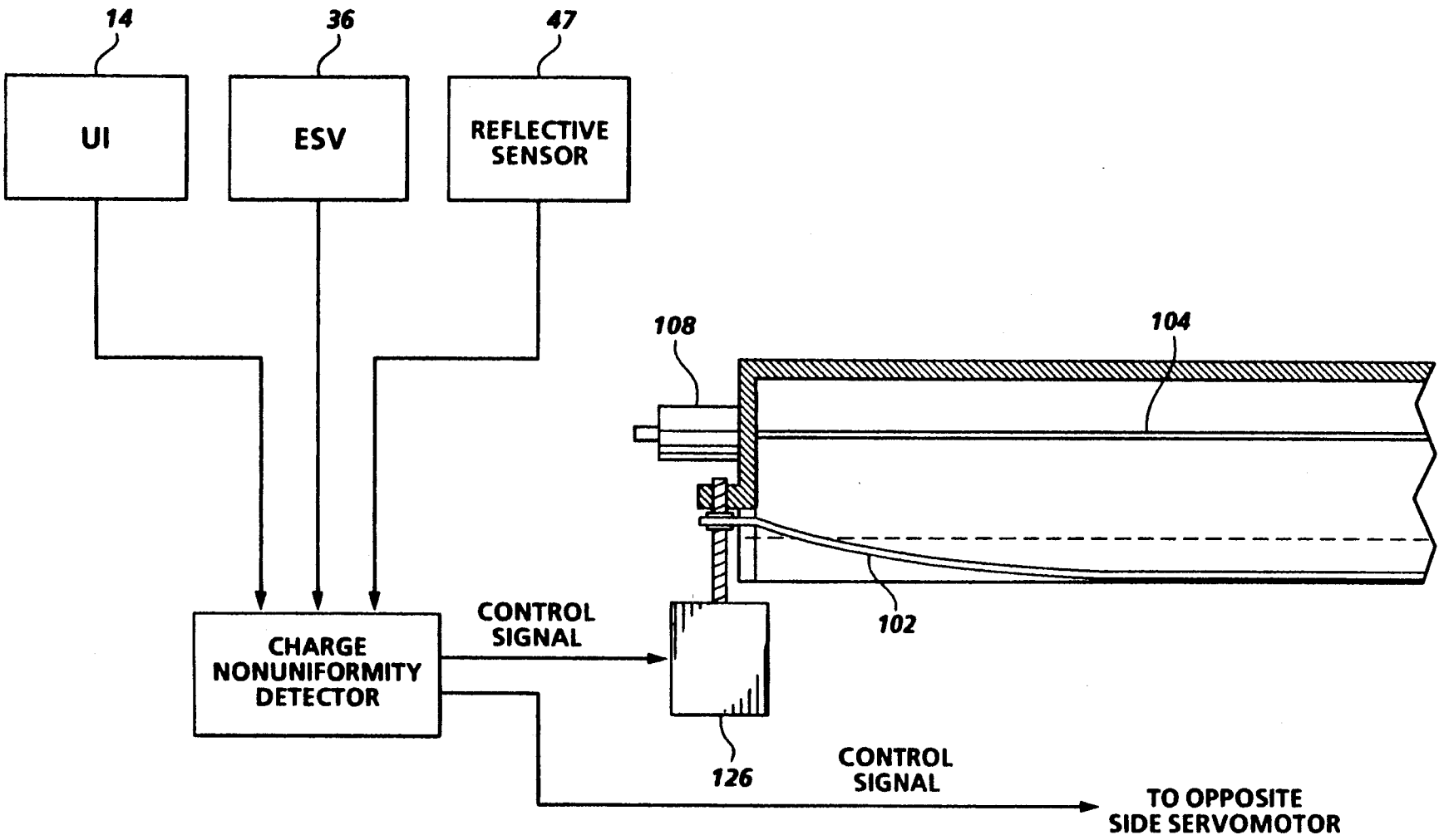
FIG. 10 is an enlarged view of the tunable scorotron of FIG. 2 in accordance with an alternative embodiment of the present invention.

In another embodiment, (FIG. 10) the thumbscrews, 118, used to adjust the position of the grid ends to alter the grid-to-photoreceptor spacing may be replaced with servomotor mechanisms, so that the adjustment of the spacing may be made automatically. More specifically, the servomotor, 126 or any similar electro-mechanical adjusting means, may be responsive to a control signal which controls the direction in which the grid ends are adjusted, over a predetermined range of motion. The control signal may be generated in response to a manual operator input, performed at user interface 14, or as an automated response to the detection of unacceptable charge nonuniformity at the edges of the imaging region. While it is known that the charging nonuniformity is measurable using an electrostatic voltmeter (EVS) 36 it is also possible to sense the result of the charging nonuniformity, namely developed toner in the background regions along the edge of the photoreceptor, in the case of a discharged area development system. Using commonly known reflectance-type toner density measurements, from reflective sensor 47 for example those described in U.S. Pat. No. 4,318,610 to Grace (issued Mar. 9, 1982), hereby incorporated by reference for its teachings, the presence of developed toner could be detected along the edges of the imaging area. In response to the detection of toner at the edges, the control signal would be generated to alter the grid-to-photoreceptor spacing until the reflectance had increased to a desirable level, due to the lack of unnecessarily developed toner in the background regions of the image area. Similarly, using an electrostatic voltmeter to monitor the potential levels at the edges of the imaging region, the control signal could be generated to alter the spacing as necessary to achieve more desirable charge density and charge potential profiles needed for uniform copy quality, such as those indicated by curves A' and B' in FIG. 8.

In recapitulation, the present invention is an apparatus for altering the relative spacing between a flexible scorotron grid and a charge retentive surface, such as a photoreceptor, in order to achieve a desired charge density and charge potential profile across the usable portion of the surface. More specifically, the relative spacing may be manually or automatically adjusted by altering the position of the ends of the flexible grid so as to deform the grid from a nominally planar configuration.

It is, therefore, apparent that there has been provided, in accordance with the present invention, an apparatus for tuning or altering the charge potential limiting effect that a scorotron grid has upon an adjacent charge receiving surface. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A scorotron charging apparatus for producing a uniform charge on a charge retentive surface, comprising:

corona producing means, spaced from the charge retentive surface, for emitting corona ions; and a flexible grid, interposed between said corona producing means and the charge retentive surface in a nonplanar fashion, said flexible grid being movable with respect to the charge retentive surface and the corona producing means so as to vary the spacing between a longitudinal portion of said flexible grid and the charge retentive surface in order to apply a uniform charge to the charge retentive surface.

2. The scorotron charging apparatus of claim 1, further comprising means for maintaining said corona producing means at a first voltage potential and said flexible grid at a second voltage potential, less than the first voltage potential.

3. The scorotron charging apparatus of claim 1, further comprising a shield, spaced apart from said flexible grid with said corona producing means interposed therebetween, said shield including means for resiliently supporting said flexible grid.

4. The scorotron charging apparatus of claim 3, wherein said resilient support means is electrically insulating so as to prevent the direct flow of electrical current between said shield and said grid.

5. The scorotron charging apparatus of claim 3, wherein said flexible grid is rigidly attached at a central region thereof to said shield, and where opposite end portions of said flexible grid are adjustable in a direction orthogonal to the charge retentive surface so as to vary the space between said flexible grid and the charge retentive surface over the end portions.

6. The scorotron charging apparatus of claim 1, further comprising grid adjusting means for altering the spacing between selected regions of said flexible grid and the charge retentive surface.

7. The scorotron charging apparatus of claim 1, wherein said flexible grid comprises a perforated, electrically conductive film.

8. A scorotron charging apparatus for producing a uniform charge on a charge retentive surface, comprising:

corona producing means, spaced from the charge retentive surface, for emitting corona ions;

a flexible grid, interposed between said corona producing means and the charge retentive surface in a nonplanar fashion, said flexible grid being movable with respect to the charge retentive surface and the corona producing means so as to vary the spacing between a portion of said flexible grid and the charge retentive surface in order to apply a uniform charge to the charge retentive surface;

grid adjusting means for altering the spacing between selected regions of said flexible grid and the charge retentive surface; and means for generating an adjustment signal, wherein said grid adjusting means automatically responds to the adjustment signal to alter the spacing between said flexible grid and the charge retentive surface.

9. An electrophotographic imaging apparatus for producing a toned image, including:

a photoconductive member;

means for charging a surface of said photoconductive member, said charging means including:

corona producing means, spaced from the surface of said photoconductive member, for emitting corona ions;

a flexible grid, interposed between said corona producing means and the surface of said photoconductive member in a nonplanar fashion, said flexible grid being movable with respect to the surface of said photoconductive member and the corona producing means so as to vary the spacing between a longitudinal portion of said grid and the surface of said photoconductive member;

means for exposing the charged surface of said photoconductive member to record an electrostatic latent image thereon; and means for developing the electrostatic latent image recorded on said photoconductive member with toner to form a toned image thereon.

10. The electrophotographic imaging apparatus of claim 9, wherein said charging means further comprises means for maintaining said corona producing means at a first voltage potential and said flexible grid at a second voltage potential, less than the first voltage potential.

11. The electrophotographic imaging apparatus of claim 9, wherein said charging means further comprises a shield, spaced apart from said flexible grid, with said corona producing means being interposed therebetween, said shield including means for suspending said flexible grid therefrom.

12. The electrophotographic imaging apparatus of claim 11, wherein said suspending means is electrically insulating so as to prevent a direct flow of electrical current between said shield and said flexible grid.

13. The electrophotographic imaging apparatus of claim 11, wherein:

said flexible grid is rigidly attached at a central region thereof to said shield, and opposite ends of said flexible grid are adjustable in a direction orthogonal to the surface of said photoconductive member.

14. The electrophotographic imaging apparatus of claim 13, further comprising grid adjusting means, in contact with the opposite ends of said grid, for altering the spacing between selected regions of said flexible grid and the surface of said photoconductive member.

15. The electrophotographic imaging apparatus of claim 9, wherein said flexible grid comprises a perforated, electrically conductive film.

16. An electrophotographic imaging apparatus for producing a toned image, including:

a photoconductive member;

means for charging a surface of said photoconductive member, said charging means including corona producing means, spaced from the surface of said photoconductive member, for emitting corona ions;

a flexible grid, interposed between said corona producing means and the surface of said photoconductive member in a nonplanar fashion with the spacing between said grid and the surface of said photoconductive member being variable along at least a region of said grid;

means for exposing the charged surface of said photoconductive member to record an electrostatic latent image thereon;

means for developing the electrostatic latent image recorded on said photoconductive member with toner to form a toned image thereon;

means for detecting a charge nonuniformity across the surface of said photoconductive member and generating a signal indicative thereof; and means for automatically adjusting the spacing between said flexible grid and the surface of said photoconductive member as a function of the signal from said detecting means.

17. The electrophotographic imaging apparatus of claim 16, wherein said detecting means comprises an electrostatic voltage matter traversing the surface of said photoconductive member.

18. The electrophotographic imaging apparatus of claim 16, wherein said detecting means comprises a reflective sensor which senses the presence of unnecessary developed toner along an edge of said photoconductive member.

* * * * *